US005236439A

United States Patent [19]

Kozikowski

[11] Patent Number: 5,236,439

[45] Date of Patent: Aug. 17, 1993

[54] RAZOR CARTRIDGE WITH IMPROVED RINSABILITY

[75] Inventor: Stanislaw D. Kozikowski, Milford, Conn.

[73] Assignee: Warner-Lambert Company, Morris Plains, N.J.

[21] Appl. No.: 843,863

[22] Filed: Feb. 25, 1992

[51] Int. Cl.[5] ..... B26B 21/00

[52] U.S. Cl. ..... 30/50; 30/47; 30/346.57; 30/346.58

[58] Field of Search ..... 30/32, 50, 51, 346.57, 30/346.58, 346.59, 47

[56] References Cited

U.S. PATENT DOCUMENTS 4,200,976 3/1980 Gooding ..... 30/50 X

*Primary Examiner*—Douglas D. Watts

*Attorney, Agent, or Firm*—Charles W. Almer; M. Andrea Ryan

[57] ABSTRACT

A rinsable twin bladed shaving cartridge is attachable to a handle and includes a support having an upper platform on which a cap blade is mounted and a lower platform on which a seat blade is mounted. At least one post connects the upper platform to the lower platform to hold the blades substantially parallel to each other and to establish a substantially unobstructed passageway for rinsing debris from around and between the blades.

16 Claims, 2 Drawing Sheets

RAZOR CARTRIDGE WITH IMPROVED RINSABILITY

FIELD OF THE INVENTION

The present invention pertains generally to razor blade shaving cartridges. More particularly the present invention pertains to multi-blade shaving systems. The present invention is particularly, but not exclusively, useful as a multi-blade shaving system which is easily rinsable to remove debris filling the interblade spaces to maintain the effectiveness of the cutting blades.

BACKGROUND OF THE INVENTION

Twin bladed razor systems for shaving hair form a body surface are well known and widely used. Typically, such razor systems incorporate a razor cartridge on which the two blades are mounted. More specifically, the blades are normally spaced apart from each other and are mounted on the cartridge in parallel. Additionally, the cartridge typically includes a guard bar which provides structure for guiding the blades into contact with the surface to be shaved. The cartridge, in turn, is attachable to a handle which is used to maneuver the cartridge and its blades during a shaving operation. For purposes of establishing nomenclature and structural interaction, it is to be appreciated that the leading blade is commonly referred to as the seat blade, and the trailing blade is commonly referred to as the cap blade. Further, the seat blade is normally positioned so as to be between the cap blade and the guard bar.

One significant disadvantage to presently available twin bladed razor systems is the fact that debris easily accumulates in the space between the blades. The unwanted result is that this accumulation diminishes the efficacy of the blades to cut hair. When compared to the condition where there is no debris in the space between the blades, it has been determined that the build up of debris in the space between the blades can reduce the effectiveness of the cap blade by almost eighty percent (80%). This reduction in efficiency will also result for the seat blade if the space between the guard bar and the seat blade is also allowed to accumulate debris. Further, it is believed that the build up of debris contributes to discomfort during the shaving operation.

In order to alleviate the above mentioned disadvantages, the user normally rinses the razor cartridge during shaving in an attempt to clear debris from the cartridge. If effective, this rinsing will improve the cutting effectiveness of the razor as well as contribute to user comfort. It happens, however, that the spacers which are presently used to stabilize the blades of a typical twin bladed razor cartridge do not permit rinse water to flow easily between the blades. More specifically, because these spacers are normally solid structures, they effectively obstruct the flow of rinse water through the space between the blades in the direction perpendicular to the cutting edges of the blades. The flow of rinse water parallel to the blades does not efficiently contact the accumulated debris and, consequently, debris tends to collect between the blades.

In light of the above, it is an object of the present invention to provide a rinsable twin bladed shaving cartridge which avoids clogging of the space between the blades in order to minimize the accumulation of shaving debris in the cartridge. Another object of the present invention is to provide a rinsable twin bladed shaving cartridge which has improved rinsability to facilitate the removal of debris which accumulates between the blades during a shaving operation. Yet another object of the present invention is provide a rinsable twin bladed shaving cartridge which is comfortable and safe to use. Still another object of the present invention is to provide a rinsable twin bladed shaving cartridge which is simple to use, relatively easy to manufacture and comparatively cost effective.

SUMMARY OF THE INVENTION

A rinsable twin bladed shaving cartridge includes a support which has a cap blade attached to an upper platform, and a seat blade attached to a lower platform. At least one post connects the rear edge of the upper platform to the rear edge of the lower platform. As so connected, the platforms align the cutting edge of the cap blade with the cutting edge of the seat blade and extend both of the cutting edges forward from the cartridge. This connection also holds the blades parallel to each other and establishes a substantially unobstructed passageway through the cartridge to facilitate the rinsing of accumulated debris from between and around the blades.

In one embodiment of the present invention, the cartridge is attachable to a handle which is formed with a guard bar. When this handle is attached to the support, the guard bar is disposed substantially parallel to the seat blade, and on the opposite side of the seat blade from the cap blade. Further, the guard bar is distanced from the support to establish a substantially unobstructed channel between the guard bar and the support. This channel also facilitates the rinsing of accumulated debris from the cartridge.

In another embodiment of the present invention, the cartridge again includes a support which has upper and lower platforms on which a cap blade and a seat blade are respectively mounted. As before, a post connects the upper platform to the lower platform to establish a substantially unobstructed passageway through the cartridge between the blades. Additionally, the cartridge itself includes an elongated guard bar which is formed substantially parallel to both the upper and lower platforms to position the seat blade between the guard bar and the cap blade. Further, the guard bar is distanced from the seat blade to establish a substantially unobstructed channel between the guard bar and the seat blade. With both the passageway and the channel, the cartridge is rinsable to remove debris which accumulates around and between the blades during a shaving operation. For this embodiment, a handle can be attached to either the lower platform or to the guard bar for controlling the cartridge during the shaving operation.

The novel features of this invention, as well as the invention itself, both as to its structure and its operation will be best understood from the accompanying drawings, taken in conjunction with the accompanying description, in which similar reference characters refer to similar parts, and in which:

DESCRIPTION OF THE PREFERRED EMBODIMENTS

Figure 1:
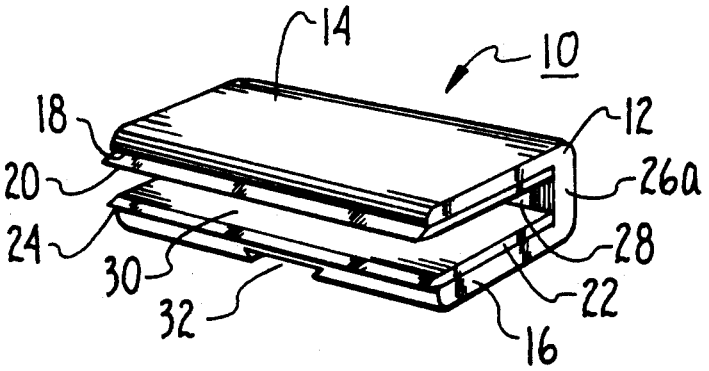
FIG. 1 is a perspective view of a preferred embodiment of the twin bladed shaving cartridge of the present invention.

Referring initially to FIG. 1, the twin bladed shaving cartridge according to the present invention is shown and is generally designated 10. As shown in FIG. 1, this embodiment of cartridge 10 includes a support 12 which is formed with an upper platform 14 and a lower platform 16. A cap blade 18 is attached to the lower surface of the upper platform 14 with its cutting edge 20 extending in a forward direction from the cartridge 10. The cap blade 18 can be attached to the upper platform 14 in any manner well known in the pertinent art. Similarly, a seat blade 22 is attached to the upper surface of the lower platform 16 with its cutting edge 24 extending in a forward direction from the cartridge 10. Preferably, when blades 18 and 22 are mounted on the support 12, the cutting edge 20 of cap blade 18 is parallel to the cutting edge 24 of seat blade 22.

Figure 2:
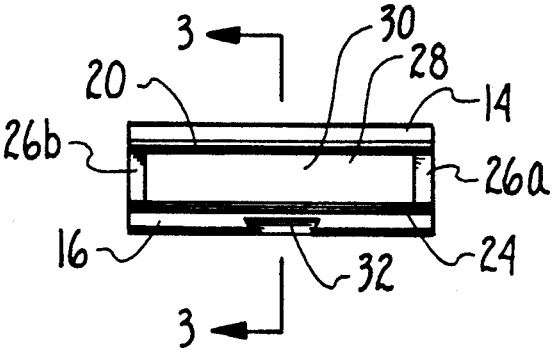
FIG. 2 is a front elevational view of the twin bladed shaving cartridge shown in FIG. 1.
Figure 3:
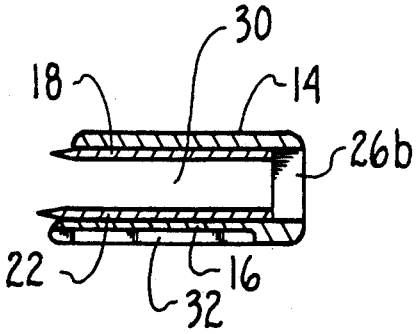
FIG. 3 is a cross sectional view of the shaving cartridge of the present invention as seen along the line 3—3 in FIG. 2.

As perhaps best appreciated by cross referencing FIGS. 1, 2 and 3, a pair of side posts 26*a* and 26*b* connect the rear edge of the upper platform 14 to the rear edge of the lower platform 16. As intended for the present invention, this connection establishes an aperture 28 between the side posts 26*a* and 26*b* which is sufficiently large to create a substantially unobstructed passageway 30 between the cap blade 18 and the seat blade 22. Additionally, FIG. 1 shows that the support 12 can be formed with a groove 32 which is useful for attaching the cartridge 10 to a handle 34.

Figure 4:
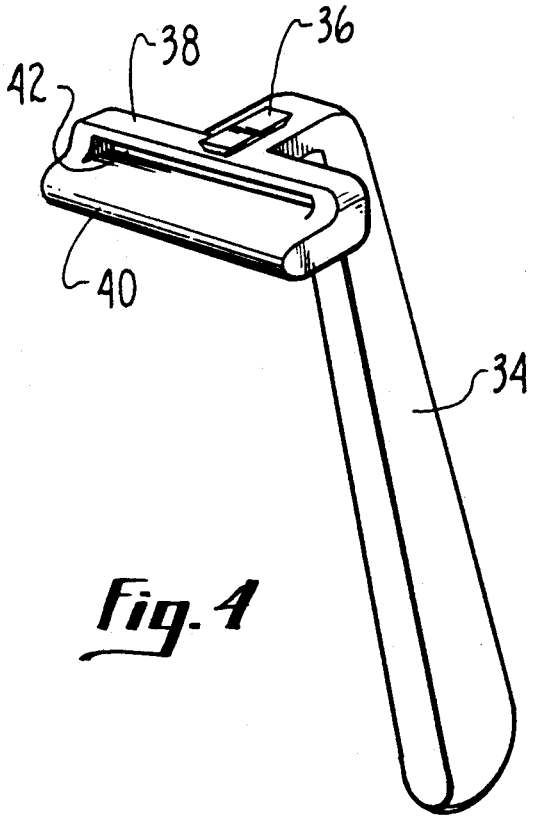
FIG. 4 is a perspective view of a handle for use with the embodiment of the present invention shown in FIG. 1.

FIG. 4 shows a handle 34 which can be used with the embodiment of the cartridge 10 shown in FIGS. 1,2 and 3. Specifically, the version of handle 34 shown in FIG. 4 includes a rib 36 which is matingly engageable with the groove 32 of cartridge 10 to hold the cartridge 10 on the handle 34. It is to be appreciated, however, that the handle 34 and the disclosed connection between this handle 34 and the cartridge 10 are only exemplary. Indeed, the cartridge 10 can be attached to any handle, such as handle 34, by any means well known in the pertinent art.

For the specific handle 34 shown in FIG. 4, it will be seen that a brace 38 extends outwardly from the handle 34, and that the brace 38 holds an elongated guard bar 40 at a distance from the brace 38. Specifically, the distance between the brace 38 and the guard bar 40 establishes a channel 42 therebetween. Thus, when cartridge 10 is attached to the handle 34, guard bar 40 will be distanced from the lower platform 16 of support 12 and the channel 42 will be unobstructed. Consequently, for the combination of cartridge 10 and handle 34, a substantially unobstructed passageway is established between cap blade 18 on upper platform 14 and seat blade 22 on lower platform 16 and, at the same time, a substantially unobstructed channel 42 is established between the lower platform 16 and guard bar 40. As intended for the present invention, the passageway 30 and the channel 42 both allow the flow of water therethrough to effectively rinse the cartridge 10 of any debris which might accumulate on the cartridge 10 during a shaving operation.

Figure 5:
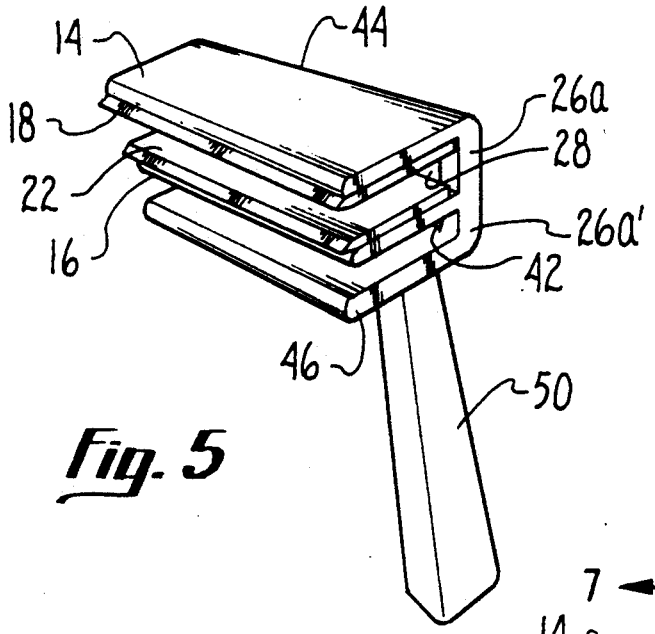
FIG. 5 is a perspective view of an alternate embodiment of the twin bladed shaving cartridge of the present invention shown attached to a handle.

For an alternate embodiment of the present invention, a guard bar 46 is attached directly to the support 12 in a manner as shown in FIG. 5 for a cartridge 44. In many respects, this cartridge 44 is similar to the previously disclosed cartridge 10. Impliedly, however, the difference is that guard bar 46 is formed as part of the cartridge 44. Specifically, like cartridge 10, the cartridge 44 has an upper platform 14 with a cap blade 18 attached thereto, and it has a lower platform 16 with a seat blade 22 attached thereto. As before, the cap blade 18 and the seat blade 22 are substantially parallel to each other and the side posts 26 create an aperture 28 which is a continuation of the passageway 30 established between the blades 18 and 22. Unlike cartridge 10, however, cartridge 44 includes side posts 26*a*' and 26*b*', which are extensions of the side posts 26*a* and 26*b* and, which hold the guard bar 46 in position relative to lower platform 18.

Figure 6:
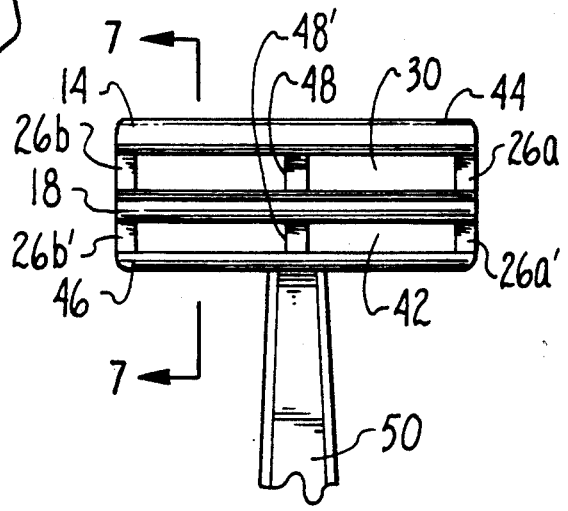
FIG. 6 is a front elevational view of the embodiment of the present invention shown in FIG. 5 with portions broken away for convenience.
Figure 7:
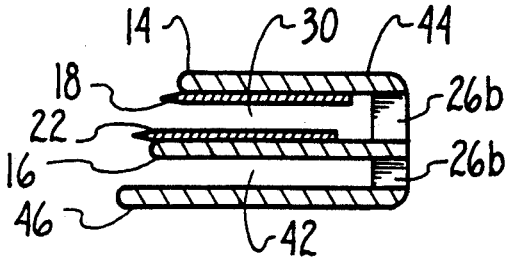
FIG. 7 is a cross-section view of the shaving cartridge of the alternate embodiment of the present invention as seen along the line 7—7 in FIG. 6.

As perhaps best seen by cross referencing FIG. 5 with FIGS. 6 and 7, the cartridge 44 is established with an essentially unobstructed passageway 30 between the blades 18 and 22, as well as an essentially unobstructed channel 42 between the seat blade 22 and the guard bar 46. Further, the cartridge 44 is shown to include a pair of center posts 48 and 48' which can be used to help stabilize the combination of upper platform 14, lower platform 16 and guard bar 46. Though the center posts 48 and 48' are shown specifically for the embodiment of the cartridge 44 illustrated in FIGS. 5 and 6, it is to be appreciated that the cartridge 10 could also include a center post. As shown in FIG. 5, a handle 50 is attachable to the cartridge 44 for guiding the cartridge 44 during a shaving operation. Here, the handle 50 is shown attached to the guard bar 46 portion of the cartridge 44.

Figure 8:
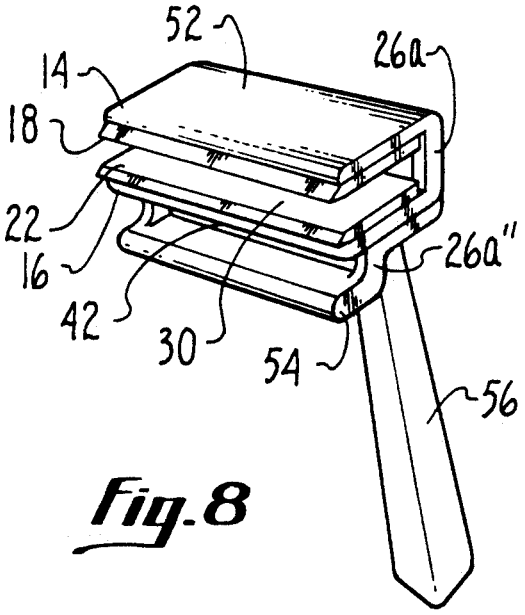
FIG. 8 is a perspective view of yet another embodiment of the twin bladed shaving cartridge of the present invention shown attached to a handle.

FIG. 8 shows yet another embodiment of the present invention wherein a cartridge 52 is formed with an integral guard bar 54. Here, in a slightly different configuration than presented above for the cartridge 44, side posts 26*a*'' and 26*b*'' (not shown) are forward on the lower platform 16. In all important respects, however, the cartridge 52 is functionally similar to the cartridge 44. As before, a channel 42 is formed between the lower platform 16 and the lower guard bar 46 to establish a substantially unobstructed channel 42. Further, the substantially unobstructed passageway 30 is established between the upper platform 14 and the lower platform 16. For this configuration, a handle 56 is shown to be attachable to the lower platform 16 of the cartridge 52. As with the other embodiments disclosed herein, the handle 56 is attachable to the cartridge 52 for guiding the cartridge 52 during a shaving operation.

While the particular twin bladed shaving cartridge as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A rinsable twin bladed shaving cartridge which comprises:

a substantially flat cap blade having a cutting edge;

a substantially flat seat blade having a cutting edge; and means for holding said cap blade parallel to said seat blade with said cutting edges aligned to establish a substantially unobstructed passageway through said cartridge between said cap blade and said seat blade for rinsing debris therefrom;

wherein said holding means comprises a support having an upper platform with a forward edge, a rear edge, and a lower surface, a lower platform having a forward edge, a rear edge, and an upper surface, and at least one post connecting said rear edge of said upper platform to said rear edge of said lower platform, and wherein said cap blade is attached to said lower surface of said upper platform to align its cutting edge with said forward edge of said upper platform and said seat blade is attached to said upper surface of said lower platform to align its cutting edge with said forward edge of said lower platform.

2. A shaving cartridge as recited in claim 1 further comprising a pair of side posts, each said side post positioned clear of said passageway and connecting said upper platform with said lower platform.

3. A shaving cartridge as recited in claim 2 further comprising a handle attachable to said support for controlling said support during shaving.

4. A shaving cartridge as recited in claim 3 wherein said handle is formed with an elongated guard bar, said guard bar being disposed substantially parallel to said seat blade and opposite said cap blade therefrom when said handle is attached to said support.

5. A shaving cartridge as recited in claim 4 wherein said guard bar is distanced from said support to establish a substantially unobstructed channel therebetween.

6. A shaving cartridge as recited in claim 3 wherein said support further comprises an elongated guard bar, said guard bar being disposed substantially parallel to said seat blade and opposite said cap blade therefrom, and said guard bar being distanced from said seat blade to establish a substantially unobstructed channel therebetween.

7. A shaving cartridge as recited in claim 6 wherein said handle is attachable to said guard bar.

8. A shaving cartridge as recited in claim 6 wherein said handle is attachable to said lower platform of said support.

9. A shaving cartridge as recited in claim 6 wherein said support is made of a plastic material.

10. A rinsable twin bladed shaving cartridge which comprises:

a first platform having an upper surface and a lower surface;

a second platform having an upper surface and a lower surface;

at least one post connecting said first platform to said second platform to hold said second platform below said first platform and establish a substantially unobstructed passageway therebetween;

a cap blade attached to said lower surface of said first platform; and a lower blade attached to said upper surface of said second platform;

wherein said cap blade is substantially parallel to said seat blade; and wherein the shaving cartridge further comprises a pair of side posts, wherein one of each of said side posts is positioned at each end of said passageway and connecting said upper platform with said lower platform.

11. A shaving cartridge as recited in claim 10 further comprising a handle attachable to said support for controlling said support during shaving, said handle being formed with an elongated guard bar disposed substantially parallel to said seat blade and opposite said cap blade therefrom, and wherein said guard bar is distanced from said support to establish a substantially unobstructed channel therebetween when said handle is attached to said support.

12. A shaving cartridge as recited in claim 10 further comprising a handle attachable to said support for controlling said support during shaving, said support having an elongated guard bar disposed substantially parallel to said seat blade and opposite said cap blade therefrom, and wherein said guard bar is distanced from said seat blade to establish a substantially unobstructed channel therebetween, said handle being attachable to said guard bar.

13. A shaving cartridge as recited in claim 10 further comprising a handle attachable to said support for controlling said support during shaving, said support having an elongated guard bar disposed substantially parallel to said seat blade and opposite said cap blade therefrom, and wherein said guard bar is distanced from said seat blade to establish a substantially unobstructed channel therebetween, said handle being attachable to said lower platform of said support.

14. A rinsable twin bladed shaving cartridge which comprises:

a support having an upper platform with a forward edge and a rear edge, a lower platform having a forward edge and a rear edge, and at least one post connecting said rear edge of said upper platform to said rear edge of said lower platform to hold said upper platform relative to said lower platform and establish a substantially unobstructed passageway therebetween;

a cap blade attached to said upper platform; and a seat blade attached to said lower platform;

wherein said shaving cartridge further comprises a handle attachable to said support for controlling said support during shaving, said handle being formed with an elongated guard bar disposed substantially parallel to said seat blade and opposite said cap therefrom, and wherein said guard bar is distanced from said support to establish a substantially unobstructed channel therebetween when said handle is attached to said support.

15. A shaving cartridge as recited in claim 14 further comprising a handle attachable to said support for controlling said support during shaving, said support having an elongated guard bar disposed substantially parallel to said seat blade and opposite said cap blade therefrom, and wherein said guard bar is distanced from said seat blade to establish a substantially unobstructed channel therebetween, said handle being attachable to said guard bar.

16. A shaving cartridge as recited in claim 14 further comprising a handle attachable to said support for controlling said support during shaving, said support having an elongated guard bar disposed substantially parallel to said seat blade and opposite said cap blade therefrom, and wherein said guard bar is distanced from said seat blade to establish a substantially unobstructed channel therebetween, said handle being attachable to said lower platform of said support.

* * * * *